US008511017B2

(12) United States Patent
Semidey

(10) Patent No.: US 8,511,017 B2
(45) Date of Patent: Aug. 20, 2013

(54) INTERLOCKING BUILDING SYSTEM

(76) Inventor: Senen Semidey, Bethesda, MD (US)

( * ) Notice: Subject to any disclaimer, the term of this patent is extended or adjusted under 35 U.S.C. 154(b) by 0 days.

(21) Appl. No.: 13/345,927

(22) Filed: Jan. 9, 2012

(65) Prior Publication Data

US 2013/0174505 A1 Jul. 11, 2013

(51) Int. Cl.
*E04B 2/38* (2006.01)
*E04B 2/32* (2006.01)
*E04B 2/72* (2006.01)

(52) U.S. Cl.
USPC ..... 52/280; 52/275; 52/272; 52/781

(58) Field of Classification Search
USPC ..... 52/275, 280, 309.11, 309.9, 284, 52/478, 474, 483.1, 764, 765, 775, 780, 781, 52/272, 261
See application file for complete search history.

(56) References Cited

U.S. PATENT DOCUMENTS 1,268,707 A * 6/1918 Gehnrich ..... 52/275
1,925,417 A * 9/1933 Swank ..... 52/284
2,076,728 A * 4/1937 Keller ..... 52/210
2,230,246 A * 2/1941 Henning ..... 52/97
2,377,702 A * 6/1945 Lindsay ..... 52/463
2,568,133 A * 9/1951 Swisher, Sr. et al. ..... 52/275
2,876,275 A * 3/1959 Schulz ..... 174/373
3,120,031 A * 2/1964 Bohnsack ..... 52/241
3,184,013 A * 5/1965 Pavlecka ..... 52/275
3,279,137 A * 10/1966 Pavlecka ..... 52/275
3,397,496 A * 8/1968 Sohns ..... 52/286
3,423,891 A * 1/1969 Burris ..... 52/241
3,440,785 A * 4/1969 Denny et al. ..... 52/275
3,564,801 A * 2/1971 Huerta ..... 52/580
3,596,424 A * 8/1971 Ward ..... 52/330
3,603,054 A * 9/1971 Didry ..... 52/282.1
3,782,063 A 1/1974 Batorewicz et al.
3,906,696 A * 9/1975 Poter et al. ..... 52/536
3,913,292 A * 10/1975 Braekkan ..... 52/406.1
3,992,839 A * 11/1976 La Borde ..... 52/275
3,998,024 A * 12/1976 Frandsen ..... 52/592.1
4,075,810 A * 2/1978 Zakrzewski et al. ..... 52/588.1
4,192,119 A * 3/1980 Murphy ..... 52/844
4,473,315 A * 9/1984 Latchinian ..... 403/172
4,641,468 A * 2/1987 Slater ..... 52/309.4
4,891,923 A * 1/1990 Ericsson et al. ..... 52/280
5,050,362 A * 9/1991 Tal et al. ..... 52/588.1
5,138,810 A * 8/1992 Kartler ..... 52/254
D332,148 S * 12/1992 Tal et al. ..... D25/138
5,305,567 A * 4/1994 Wittler ..... 52/238.1
5,313,751 A * 5/1994 Wittler ..... 52/238.1
5,349,796 A * 9/1994 Meyerson ..... 52/309.11
5,359,816 A * 11/1994 Iacouides ..... 52/274
5,433,047 A * 7/1995 Wallace et al. ..... 52/284

(Continued)

*Primary Examiner* — Phi A
(74) *Attorney, Agent, or Firm* — Michael L. Greenberg, Esq.; Greenberg & Lieberman, LLC

(57) ABSTRACT

An apparatus constituting the walls and frame of a building with a series of interlocking panels, preferably composed of two sheets of metal, bound together by polyurethane foam injected between them. The panels are secured to the floor via metallic columns found at each juncture between two panels. Electric assemblies and setups, as well as plumbing outlets are preinstalled within the panels, facilitating rapid installation. Windows, doors, and A/C vents are also crafted into the panels at their inception, prior to their transport to the construction site. It is the intent of the present invention to provide an avenue for affordable, durable, and efficient housing that may be constructed quickly with minimal effort in the absence of heavy machinery, and without any advanced tools.

16 Claims, 5 Drawing Sheets

(56) References Cited

U.S. PATENT DOCUMENTS

| | | | | |
|---|---|---|---|---|
| 5,673,524 | A * | 10/1997 | Gailey | 52/309.9 |
| 5,758,461 | A | 6/1998 | McManus | |
| 6,085,485 | A * | 7/2000 | Murdock | 52/783.19 |
| 7,025,530 | B2 * | 4/2006 | Beamish et al. | 404/41 |
| 7,160,055 | B2 * | 1/2007 | Beamish et al. | 404/36 |
| 7,356,970 | B1 * | 4/2008 | Frobosilo | 52/261 |
| 7,621,589 | B1 * | 11/2009 | Gerome | 296/186.1 |
| 8,037,655 | B2 * | 10/2011 | Hanya et al. | 52/579 |
| 8,141,325 | B2 * | 3/2012 | Cheng et al. | 52/792.11 |
| 8,146,314 | B2 * | 4/2012 | Nguyen | 52/478 |
| 2003/0110730 | A1 * | 6/2003 | Vos | 52/588.1 |
| 2011/0061335 | A1 | 3/2011 | Scheckler | |

* cited by examiner

INTERLOCKING BUILDING SYSTEM

FIELD OF THE PRESENT INVENTION

The present invention relates to construction materials, and more specifically, to pre-fabricated construction materials designed to create durable, economical, eco-friendly buildings rapidly with a minimal labor force and without the use of costly equipment.

BACKGROUND OF THE PRESENT INVENTION

In the quest to create more efficient, cost effective buildings, humans have endeavored to improve the materials used to construct modern buildings, as well as the system by which those materials are employed. Factors such as insulation and roofing can be critical to the cost efficiency of a building. As humans have progressed over time, adobe-based huts evolved into wood and concrete constructs, designed to be durable—to withstand the elements and stand up to the test of time. However, many modern buildings were constructed hastily, and are constructed with bricks, cinderblocks, or other heavy, cumbersome material. Employing such a dense material is more durable than wood or clay, but is time consuming and laborious to construct. Additionally, cinderblock or brick construction materials require strict coordination with plumbers and electricians to construct the building in a timely fashion. With each contractor having a different schedule, this can sometimes be difficult.

As a result of the stone building materials immense weight, costs are high to transport them to the construction site, as well as to build the blocks themselves. In turn, constructing buildings out of bricks, cinderblocks, or other concrete-like material around a predominantly wooden frame is not very cost effective. Other materials, such as polyurethane, acrylic polymers, plastics, and other similar materials are more economical and offer better insulation than traditional building materials. Unfortunately, there is currently no effective way of constructing a building solely with such alternative building materials that offers the same level of structural integrity as brick or cinderblock based buildings provide.

Thus, there exists a need for a new form of building material that provides superior insulation while remaining unitary, light-weight, economical, and eco-friendly, while being predominantly pre-fabricated prior to arriving at the construction site, saving both time and money.

U.S. Pub. No. 2011/0061335 for "Masonry Construction Using Single-Component Polyurethane Foam" by Sheckler, published on Mar. 17, 2011, shows a method of using polyurethane as a bonding agent for concrete blocks or other masonry units. Unlike the present invention, Sheckler does not mention use of polyurethane as a bonding agent for drywall or non-stone materials.

U.S. Pat. No. 3,782,063 for "Expandable Prefabricated Building System and Method of Construction" by Batorewicz et al., issued on Jan. 1, 1974, shows methods of construction for housing systems that are partially prefabricated and assembled prior to shipment to the erection site. Batorewicz et al. employs polyurethane as a "hardenable plastic" applied to portions of the structure, but no mention is made of it being used to together interlocking wall units.

U.S. Pat. No. 5,758,461 for "Lightweight, Prefabricated Building Structures" by McManus, issued on Jun. 2, 1998, shows panels for a prefabricated building that have "friction lock means for interlocking one to another." FIG. 16F shows one of these friction lock means, namely a tenon and mortise link, that appears similar to the locking means of the present invention, although no mention is made of bonding the link with polyurethane.

U.S. Pat. No. 3,397,496 for "Locking Means for Roof and Wall Panel Construction" by Sohns, issued on Aug. 20, 1968, shows wall, roof and floor modular panel units made of a plastic foam core sandwiched between resin reinforced glass fiber skins." FIG. 5 shows a side edge interlocking structure that bears some similarity to the interlocking structure used in the present invention, although the pieces are not bonded together with polyurethane.

U.S. Pat. No. 5,349,796 for "Building Panel and Method" by Meyerson, issued on Sep. 27, 1994, shows interlocking panels with a polystyrene, or equivalent material, core. The panels join at their lateral edges with an interlocking joint or snap lock assembly, so that nails or other joining elements are not needed. The interlocking panels in Meyerson connect in a manner dissimilar to the present invention.

SUMMARY OF THE PRESENT INVENTION

The present invention is a mass production building component designed for the construction and assembly of commercial, industrial, and residential buildings based on the injection of polyurethane foam between two preferably metallic panels, constituting a system of walls when interlocked together. The panels are designed to interlock with other similar panels via a unique interlocking clasp found at the ends of each panel. A metallic support column is then placed in the cavity found to exist in the juncture between any two panels, which is secured to the panels via the interlocking clasp. The support column is preferably anchored to the foundation of the building via an anchor plate embedded within the concrete. Windows and doors may be embedded within the panels when the panels are initially created, such that the polyurethane foam holds the window in place. Additionally, electrical outlets, fuse boxes, lighting assemblies, and switches, along with all accompanying wiring are preferably incorporated into the panels at their inception as well. This is preferably accomplished via a wiring cavity, often created by a PVC pipe or other cylinder being left between the two panels at the time when polyurethane is injected between them. This cavity, left behind by the PVC pipe, or the cavity within the pipe itself, is then used to house the wires required for electrical outlets and lighting fixtures which are preferably integrated into the panels as they are made as well.

Given that the electrical systems, vents, doors, and windows are pre-built into the very walls of the house, considerable time may be saved at the construction site of the building. For example, time is not wasted waiting for the electrician to arrive on-site to set up the electrical systems in the walls prior to the construction team being able to proceed, as the electric is already built into the walls, so no electrician is needed to integrate the wiring on-site. Wires routing electricity to the panels are preferably maintained in a trough which is incorporated into the crown beam. The crown beam rests atop the panels, helping to bind them together under the roof.

Roofing is easily placed atop the crown beam of the present invention, and is secured to the crown beam with a conventional mounting mechanism, as well as by joining the metal columns to the roofing material. The mounting mechanism employed for the roof is similar to the mounting mechanism employed to attach the support columns to the anchor plates held within the structure's foundation. The present invention is envisioned to be compatible with a wide variety of roofing materials, ranging from tiles, shingles, sheet metal, etc. It is envisioned that the present invention will enable a group of people to build a structure without the use of any advanced tools, welding, cranes, or heavy machinery.

It is the intent of the present invention to provide easy-to-assemble, durable, eco-friendly, efficient buildings that may be constructed in a single day with a skilled team of 8 to 10 individuals.

DETAILED DESCRIPTION OF THE PREFERRED EMBODIMENT

Figure 1:
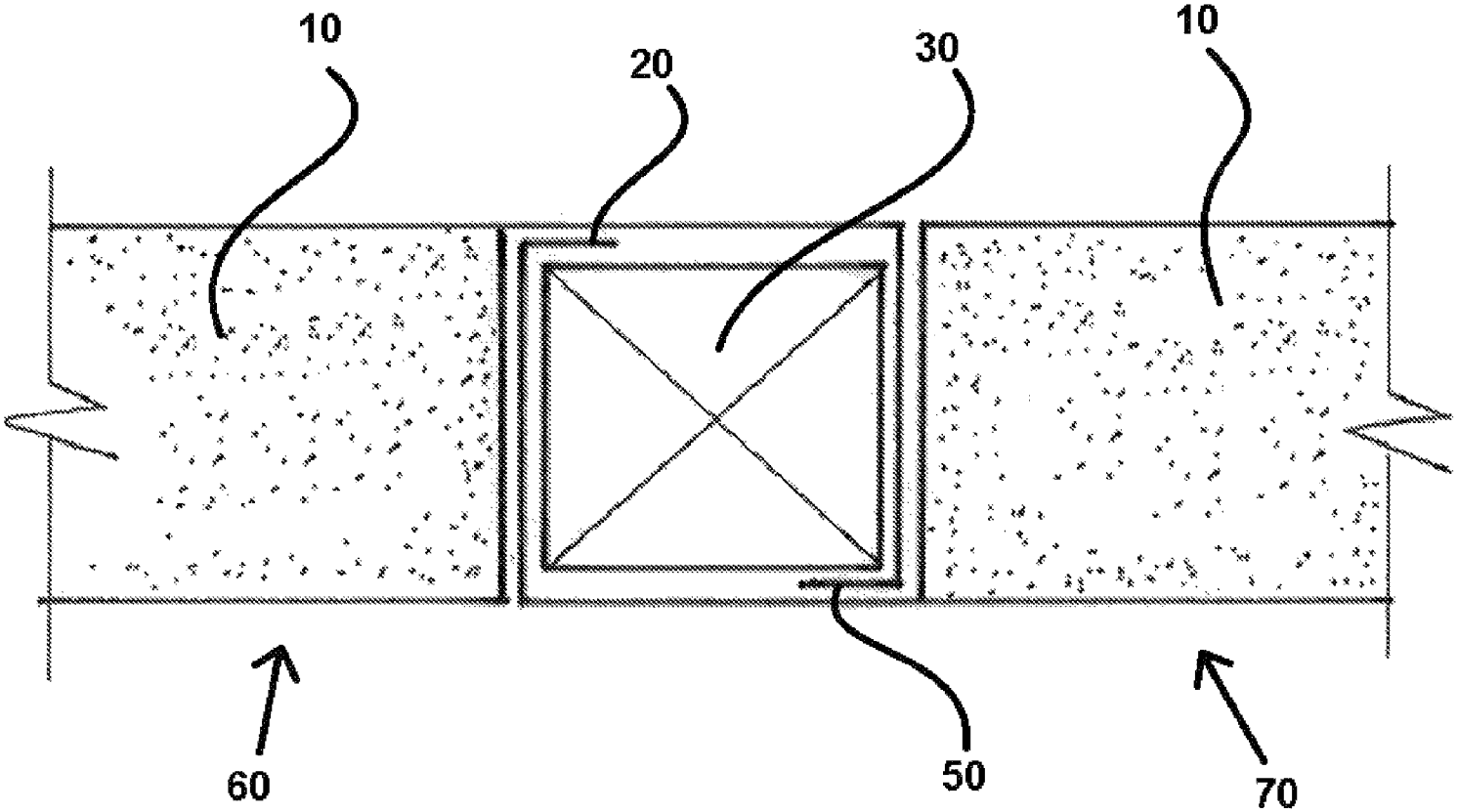
FIG. 1 shows an illustration of the interlocking edges of the present invention as viewed from above.

The present invention is a pre-fabricated wall panel designed for the construction of buildings. It has two parallel, preferably metallic sheets, shown as sheets (180) bound together with a polyurethane layer (10), preferably foam, injected between the sheets (180), making the present invention a panel (100) that is unitary, designed to construct the wall (65) of a building. The present invention employs a support column (30), preferably composed of metal, which serves to anchor the present invention to the foundation of a building via a mounting mechanism (160), as well as to provide a common anchor point for panels (100). Each panel (100) has a first end (20) and a second end (50), which are preferably shaped as hook-shaped extensions. The hook-shaped extensions on either side of the panel (100) are such that they are mirrored opposites of each other, as seen in FIG. 1, which shows the junction of two panels (100), forming a wall (65) for a building. This feature is critical to the support system of the present invention, as a first panel (60) and a second panel (70), of the present invention to be easily interlocked together in a series, forming a wall (65) as seen in FIG. 1, thus constituting the interior and exterior walls of a building. The panels (100) are designed to be interlocked together without the use of any rivets, screws, welding, or heavy duty equipment. By the nature of the manner by which the panels (100) interlock together via the hook-shaped extensions, aided by the support column (30), the junction of the panels cannot be observed from outside of the structure, as the junction appears to be seamless.

The walls (65) of the building have been created to sustain both hot and cold weather while maintaining an ideal temperature indoors. This is due in part to a polyurethane layer (10) found as the core of the present invention, which provides optimal insulation while simultaneously providing structural integrity to a building constructed with the present invention. While other foam materials could be employed, polyurethane foam is preferred for a variety of reasons; namely, it is a lightweight, strong insulator that is sticky and fast expanding, assisting its adherence to the panels (100) of the present invention, as well as other exposed components. Additionally, termites do not eat polyurethane, and other insects cannot such a polyurethane layer (10) penetrate it, helping to keep insects out of the building.

Figure 2:
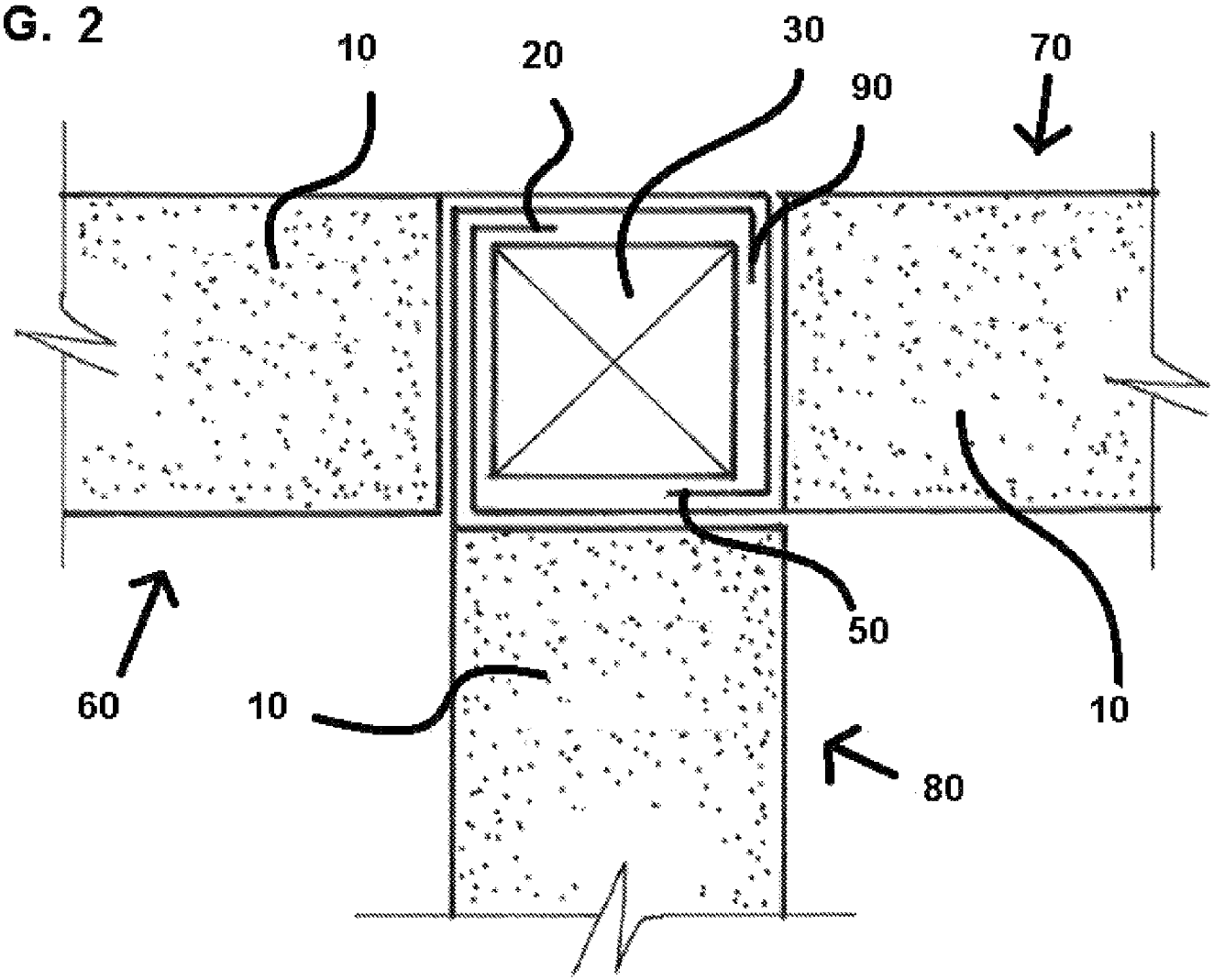
FIG. 2 shows an illustration of the present invention being employed to support a third, perpendicular panel.
Figure 3:
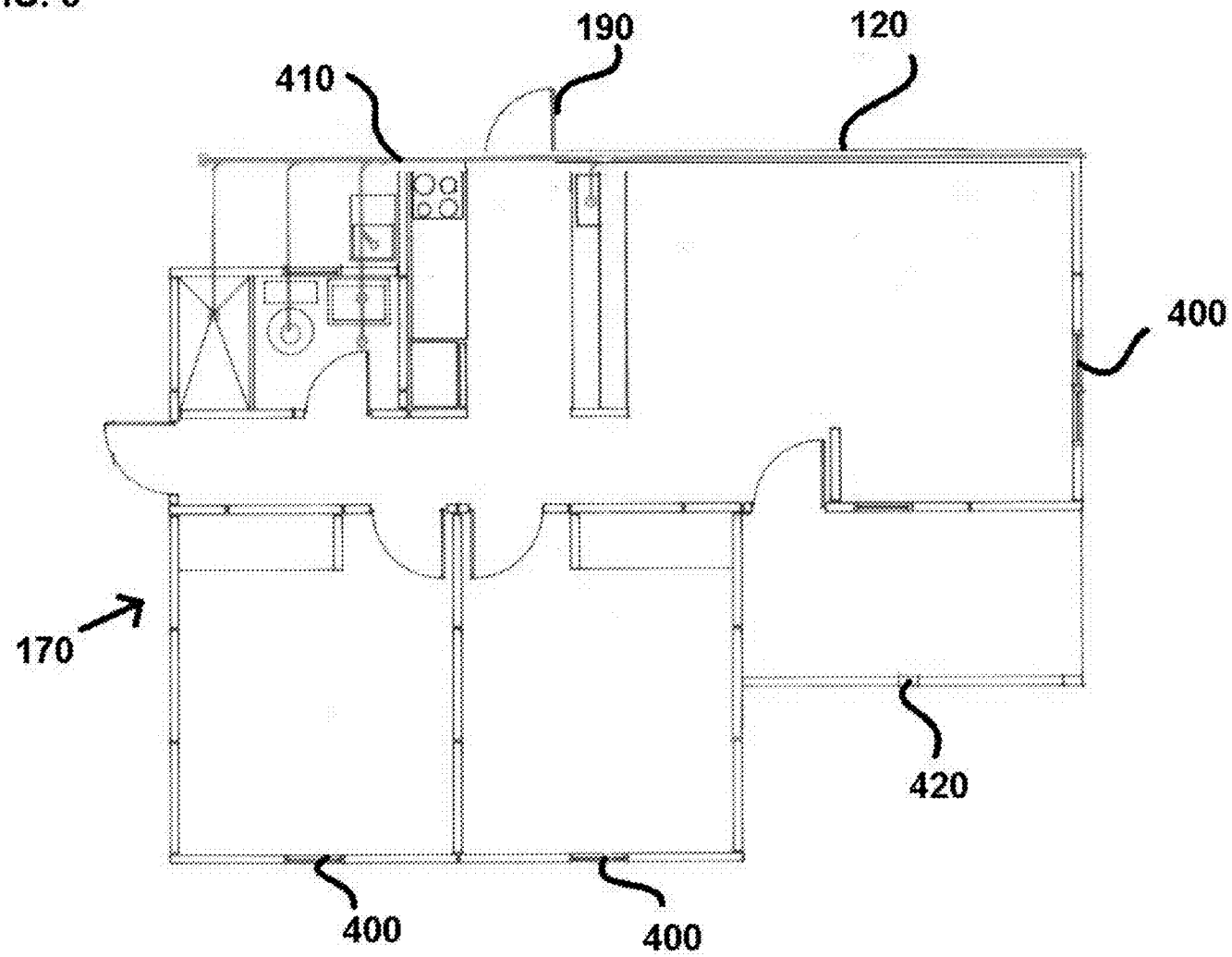
FIG. 3 displays the present invention from the side, highlighting the embedded window and integrated electrical features.

The preferred embodiment of the present invention is preferably mounted to the foundation of the building via the support columns (30), and more specifically, via the mounting mechanism (160) found at the bottom of the support columns (30), as seen in FIG. 2. As illustrated, the support columns (30) are designed to be inserted into an anchor plate (110), preferably made of steel, which is embedded within the concrete foundation of the building. The mounting mechanism (160) may consist of a traditional expansion clasp, similar to those found on conventional umbrellas, only larger and made with more durable materials. It is envisioned that, regardless the conventional clasp used as a mounting mechanism (160), the clasp is preferably permanent, such that the destruction of the foundation of the building would be required in order to dismount the support columns (30) from the anchor plate (10).

It is envisioned that there are approximately five differing, generic types of the present invention that are created to be used to construct buildings. Each type is simply a differing form of the same concept—namely a polyurethane injected panel which employ a specific form of edge that is able to interlock with the edges of other panels, all of which are anchored to the foundation for stability. Types may include a window wall panel, an electrical wall panel, a door panel, vent panels, and standard blank panels. Additionally, the underlying roof panels are preferably constructed similarly to the panels (100) of the present invention.

A crown beam (120) is placed atop the panels, additionally binding them together and increasing the structural integrity of the building. The crown beam is preferably composed of a single sheet of bent metal, shaped into a trough (130) approximately the same width of the panels (100). The crown beam (120), in addition to the support columns (30) and anchor plates (110) provide the strength of the structure. By employing such simplistic forms, a structure constructed with the present invention does not require any type of welding, special tools, or heavy duty equipment to successfully build a structure. It is preferably envisioned that a structure built with the present invention need not require much more than a conventional screwdriver to assemble.

The panels (100) are preferably designed according to the structural requirements in place at the location they are intended to be used. Therefore, wind speed, flood potentials, and seismic conditions are taken into consideration in order to determine the optimal dimensions of the panels (100), as well as the depth at which the anchor plates (110) should be placed in the concrete foundation. For locations prone to earthquakes, the anchor plates (110) are thicker, and other forms of mounting mechanisms (160) may be employed to secure the support columns (30) to the anchor plates (110). For example, the anchor plate itself may be of a thicker, more durable metal for installations in locales prone to frequent seismic activity. Additionally, the support columns (30) could be made of a more shatter resistant alloy to conform to the construction parameters of the structure.

Figure 5:
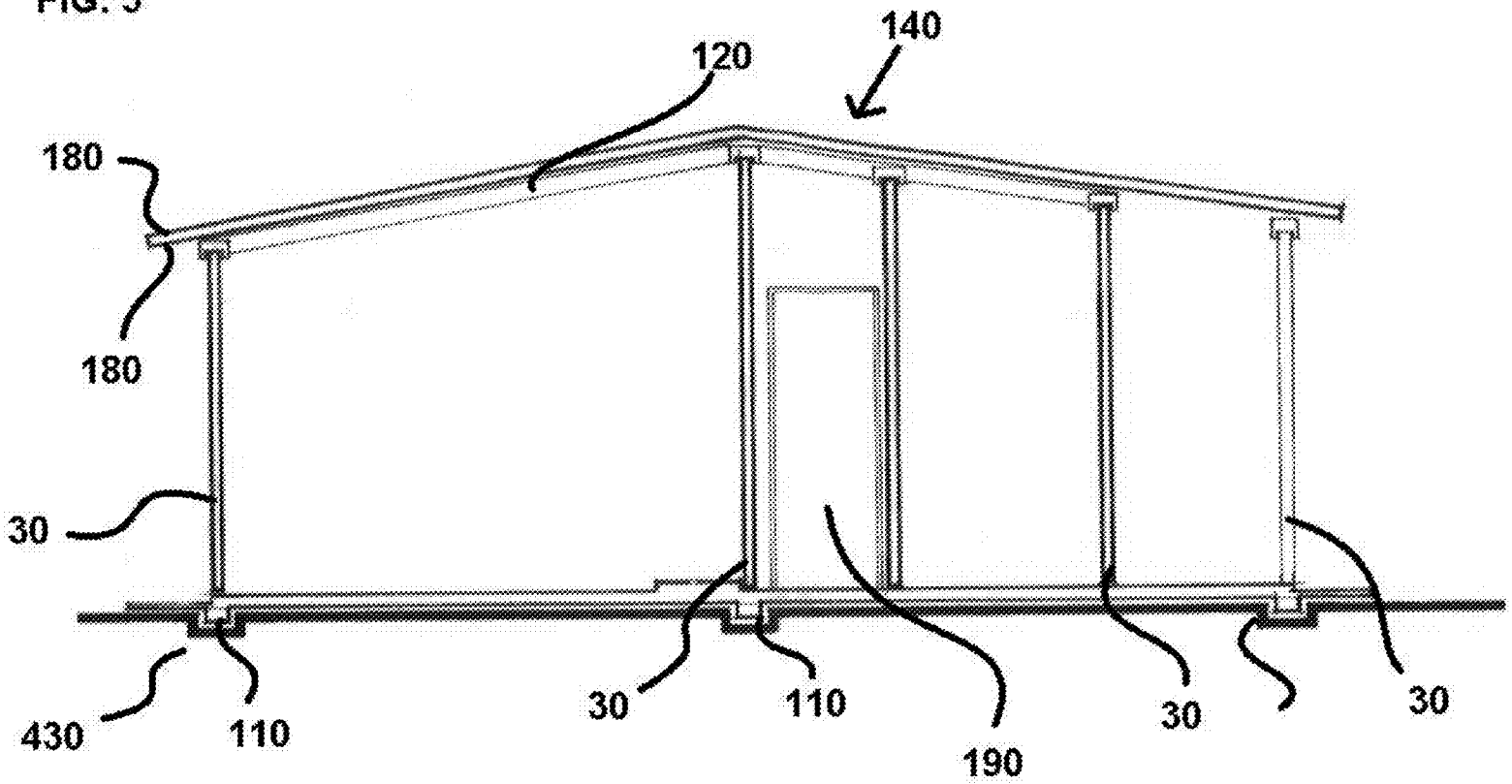
FIG. 5 illustrates the way in which the roof, support columns, and mounting mechanisms interact with the present invention.

The crown beam (120) of the present invention is preferably placed on the frame of the structure, which is established by the interlocking panels (100), as seen in FIG. 5. The crown beam (120) serves as a buffer between the roof (140) and the top of the panels (100). This buffer, shown as a trough (130), provides a space for electrical wires and plumbing to be routed to the appropriate rooms easily before the roof (140) is mounted to the structure. The roof (140) is constructed of similar panels that are injected with the polyurethane (10) foam; however, the sheets employed to make the roof panels (150) are not parallel. One sheet of the roof panel (150) is slanted to allow for the slope of the roof (140), providing an avenue for water runoff. Due to the nature of the construction of a structure in this fashion, the structures do not have attics or large vacant cavities within the roof (140). This helps to ensure optimal insulation from the elements, as well as to eliminate potential habitats for insects.

The roof panels (150) of the present invention are preferably built of a first roof sheet (180) and a second roof sheet, preferably oriented at an angle to each other, ideally similar in composition and structure to the panels employed to construct the frame (170) of the present invention. The roof panels (150) are preferably built of sheets (180), preferably arranged at an angle, bound together with an injected polyurethane layer (10), extending across the frame all in one solitary piece. This solidary helps ensure moisture does not enter the structure in the form of humidity. The mounting mechanism (160), as well as the reinforcements of the roof panels (150) are pre-installed and attached at the factory prior to the injection of the polyurethane layer (10) between the sheets (180). The anchoring of the roof panel to the beam is accomplished via mounting mechanism (160) similar to the one used for anchoring the support columns (30) to the anchor plate (110).

The mounting mechanism (160) which anchors the roof panels (150) to the crown beam (120) cannot preferably be seen from the interior or exterior of the structure. This helps to ensure that the structures constructed employing the present invention remain aesthetically pleasing, and do not display unsightly hinges, rivets, or welding junctures. The mounting mechanism (160) and reinforcements of the roof panels (150) are preferably pre-installed and attached at the factory prior to the injection of the polyurethane layer.

Figure 4:
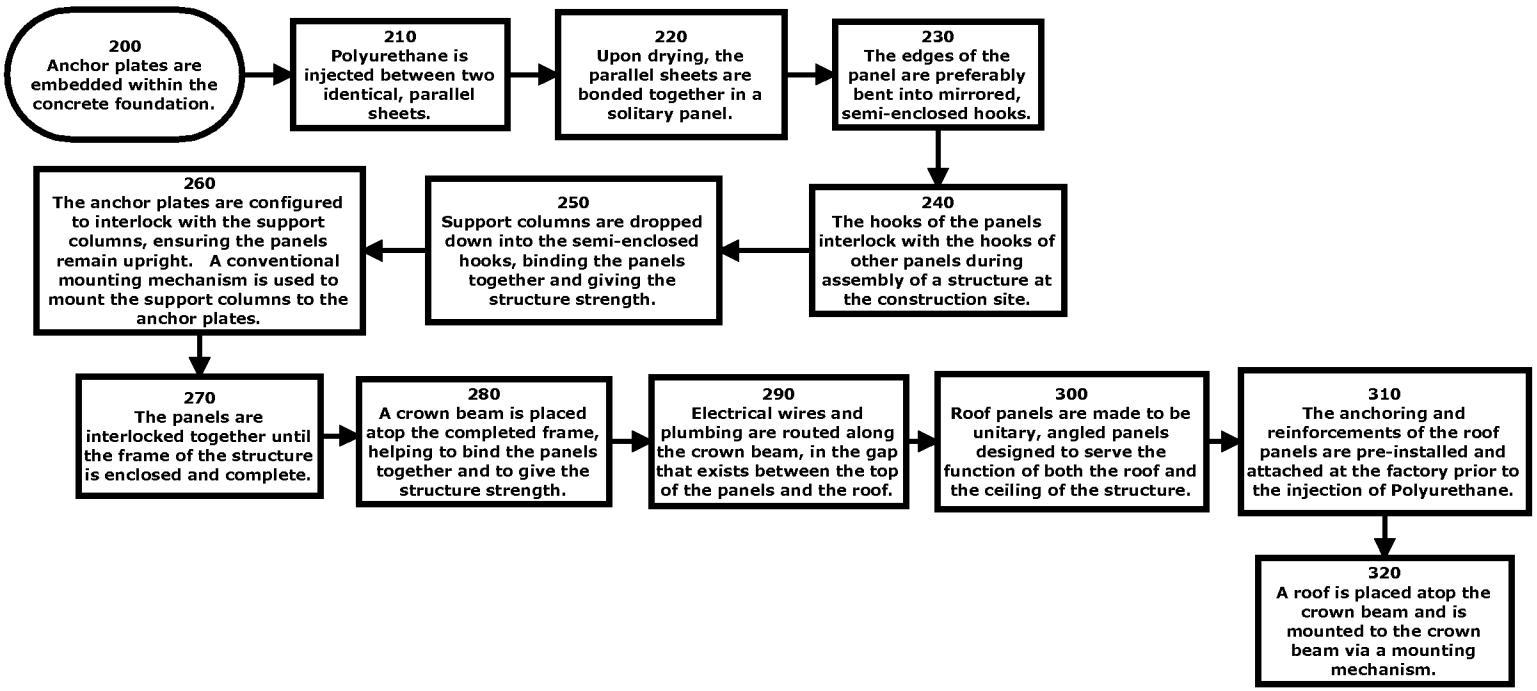
FIG. 4 exhibits a flow chart detailing the use of the present invention as a construction material.

The preferred embodiment of the present invention is best seen as it is used within the larger system of a structure's construction, as seen in FIG. 4. In summary, anchor plates are embedded within the concrete foundation (200) of a structure. Polyurethane is injected between two identical, parallel sheets (210). Upon drying, the parallel sheets are bonded together in a solitary panel (220). The edges of the panel are preferably bent into mirrored, semi-enclosed hooks (230). The hooks of the panels interlock with the hooks of other panels during assembly of a structure at the construction site (240). Support columns are dropped down into the semi-enclosed hooks, binding the panels together and giving the structure strength (250). The anchor plates are configured to interlock with the support columns, ensuring the panels remain upright.

A conventional mounting mechanism (160) is used to mount the support columns to the anchor plates (260). The panels are interlocked together until the frame of the structure is enclosed and complete (270). A crown beam is placed atop the completed frame, helping to bind the panels together and to give the structure strength (280). Electrical wires and plumbing are routed along the crown beam, in the gap that exists between the top of the panels and the roof (290). A roof is placed atop the crown beam and is mounted to the crown beam via a mounting mechanism (300). The roof (140) is composed of roofing panels, constructed in a similar fashion to that of the panels making up the walls of the present invention.

The design of the roof panels (150) are such that they are built using specially designed molds, wherein the sheets (180) are held at an angle when unified with an injection of polyurethane (10) foam. The lower sheet (180) of the roofing panel (150) inherently acts as the ceiling of the structure. This design is a critical portion of the building system, which aids in the rapid and easy assembly of the structure at the construction site by eliminating the need to create any additional ceilings, reducing erection time and overall construction costs.

The design of the structure created with the present invention ensures that there are no empty spaces within the roof portion of the structure, such as an attic. The lack of an attic helps to avoid the need for additional insulation, and assists in prevention against the invasion of insects, humidity and mold.

In alternate embodiments of the present invention, it is envisioned that other materials may be used as the sheets (180) used to create the panels (100). For example, granite or wood sheets could be fabricated to be strong enough to withstand the pressure established during the polyurethane layer injection process. These panels (100) could similarly be used to form the frame (170) and walls of a structure.

Similarly, alternate embodiments of the present invention may prefer to employ alternate conventional mounting mechanisms in their approach to the mounting and securing of the support columns (30) to the anchor plates (110) and to the roof (140) of a structure constructed with the present invention.

It is to be understood that the present invention is not limited to the embodiments as described above. There may be variations in the present invention that are not limited to the detailed description of the embodiments, but still maintain the essence of the invention as described in the specification.

To reiterate, the present invention is an interlocking building system that has a first sheet, which has a first end and a second end. A first hook-shaped extension is preferably located at the first end of the first sheet. A second sheet also has a first end and a second end. The first end of the second sheet also has a hook-shaped extension. The first sheet and the second sheet are preferably in parallel planes. A polyurethane layer (10) is injected between said first sheet and said second sheet, binding them together, and forming a first panel. The present invention also has at least one support column, at least one mounting mechanism, and at least one anchor plate. A second panel is created that is identical to the first panel. The first hook shaped extension of the first panel is interlocked to a second hook-shaped extension of the second panel. A support column (30) is disposed between the first hook-shaped extension of the first panel and the second hook-shaped extension of the second panel. The support column (30) of the present invention is inserted within the anchor plate (110), providing stability. The support column (30) is then secured to the anchor plate (110) via a mounting mechanism (160).

I claim:

1. An interlocking building system, comprising:

a first sheet, having a first end and a second end;

a first hook-shaped extension, located at said first end of said first sheet, said first hook-shaped extension being the only extension at said first end;

a second sheet having a third end and a fourth end;

a second hook-shaped extension, located at a fourth end of said second sheet, said second hook-shaped extension being the only extension at said second end;

a polyurethane layer;

a support column, said support column being a square prism;

wherein said first hook-shaped extension extends for a first length in line with said first sheet, then turns perpendicularly to said first sheet, with a second length shorter than the width of said polyurethane layer but equal to the length of said first length, then extends in line with said second sheet;

wherein said second hook-shaped extension extends for a third length in line with said second sheet, then turns perpendicularly to said second sheet, with a fourth length shorter than the width of said polyurethane layer but equal to the length of said third length, then extends in line with said first sheet;

wherein said support column exists in plane with said first sheet and said second sheet and anchors said first sheet and said second sheet in position via said first hook-shaped extension and said second hook-shaped extension.

2. The interlocking building system of claim 1, wherein said first sheet and said second sheet are in parallel planes.

3. The interlocking building system of claim 1, wherein said polyurethane layer is between said first sheet and said second sheet.

4. The interlocking building system of claim 1, wherein said first end is adjacent to said third end, and wherein said second end is adjacent to said fourth end.

5. The interlocking building system of claim 4, wherein said first hook-shaped extension and said second hook-shaped extension face opposite directions.

6. The interlocking building system of claim 1, wherein said polyurethane layer binds said first sheet and said second sheet to form a first panel.

7. The interlocking building system of claim 1, further comprising a support column.

8. The interlocking building system of claim 1, further comprising a mounting mechanism.

9. The interlocking building system of claim 1, further comprising an anchor plate.

10. The interlocking building system of claim 1, further comprising a support column, a mounting mechanism, and an anchor plate.

11. The interlocking building system of claim 6, further comprising a second panel that is identical to said first panel.

12. The interlocking building system of claim 11, wherein said first hook-shaped extension of said first panel is interlocked to a second hook-shaped extension of said second panel.

13. The interlocking building system of claim 12, wherein a support column is disposed between said first hook-shaped extension of said first panel and said second hook-shaped extension of said second panel.

14. The interlocking building system of claim 13, wherein said support column is inserted within an anchor plate.

15. The interlocking building system of claim 14, wherein said support column is attached to said anchor plate via a mounting mechanism.

16. The interlocking building system of claim 1, wherein said first sheet and said second sheet are in parallel planes;

wherein said polyurethane layer is between said first sheet and said second sheet;

wherein said first end is adjacent to said third end, and wherein said second end is adjacent to said fourth end;

wherein said first hook-shaped extension and said second hook-shaped extension face opposite directions;

wherein said polyurethane layer binds said first sheet and said second sheet to form a first panel;

further comprising a mounting mechanism;

further comprising an anchor plate;

further comprising a second panel that is identical to said first panel;

wherein said first hook-shaped extension of said first panel is interlocked with a second hook-shaped extension of said second panel;

wherein a support column is disposed between said first hook-shaped extension of said first panel and said second hook-shaped extension of said second panel;

wherein said support column is inserted within said anchor plate; and wherein said support column is attached to said anchor plate via said mounting mechanism.

* * * * *